United States Patent [19]

Rennison et al.

[11] 4,363,866

[45] Dec. 14, 1982

[54] RECORDING MATERIALS

[75] Inventors: Stuart C. Rennison, Hadleigh; Ronald J. Stacey, Colchester, both of England

[73] Assignee: Bedford Limited, London, England

[21] Appl. No.: 254,083

[22] Filed: Apr. 14, 1981

Related U.S. Application Data

[63] Continuation-in-part of Ser. No. 99,748, Dec. 3, 1979, abandoned, which is a continuation-in-part of Ser. No. 87,567, Oct. 23, 1979, abandoned.

[30] Foreign Application Priority Data

Dec. 11, 1978 [GB] United Kingdom ..... 47955/78
Aug. 6, 1979 [GB] United Kingdom ..... 7927349

[51] Int. Cl.[3] ..... G03C 5/18; G03C 5/00

[52] U.S. Cl. ..... 430/290; 430/152; 430/176; 430/191; 430/196

[58] Field of Search ..... 430/152, 176, 191, 196, 430/290

[56] References Cited

U.S. PATENT DOCUMENTS

| | | | |
|---|---|---|---|
| 3,108,872 | 10/1963 | McMahon | 430/152 |
| 3,355,295 | 11/1967 | Priest | 430/176 |
| 3,622,333 | 11/1971 | Cope | 430/152 |
| 3,622,335 | 11/1971 | Notley . | |
| 3,708,296 | 1/1973 | Schlesinger | 430/914 |
| 3,759,711 | 9/1973 | Rauner et al. | 430/152 |
| 3,960,684 | 6/1976 | Feinberg | 430/176 |
| 3,979,211 | 9/1976 | Chaikir | 430/152 |
| 4,032,344 | 6/1977 | Fletcher et al. | 430/152 |
| 4,093,463 | 6/1978 | Fletcher . | |
| 4,128,422 | 12/1978 | Fletcher et al. . | |
| 4,152,156 | 5/1979 | Voisin et al. | 430/152 |

FOREIGN PATENT DOCUMENTS

| | | | |
|---|---|---|---|
| 840377 | 4/1970 | Canada . | |
| 765683 | 5/1971 | Belgium . | |
| 1342237 | 1/1974 | United Kingdom . | |
| 326539 | 4/1972 | U.S.S.R. | 430/152 |

OTHER PUBLICATIONS

Chemical Abstracts, vol. 87 #14276c, 1977.
Chemical Abstracts, vol. 86, #148827w, 1977.
Fletcher G., Research Disclosure, #13121, 3/1975.
Kotlarchik C., Research Disclosure, #13107, 3/1975.

*Primary Examiner*—Charles L. Bowers, Jr.
*Attorney, Agent, or Firm*—Cushman, Darby & Cushman

[57] ABSTRACT

Process for forming a vesicular image utilizing a vesicular recording material having an imaging layer which includes a defined sulphone and/or sulphonamide additive in an amount of 1 to 100% by weight based upon the weight of a polymeric component of the plastics vehicle. The additive provides improved image density and a back-appearing image.

11 Claims, No Drawings

RECORDING MATERIALS

The present invention relates to photographic recording materials which may be used for vesicular imaging and a process for forming a vesicular image in such a material.

Such materials are known in the art and generally comprise a transparent or opaque film or sheet support carrying an imaging layer comprising a thermoplastics vehicle and a sensitising agent dispersed through the vehicle. The sensitising agent is decomposable on exposure to a light image to evolve a gas such as nitrogen thereby forming a latent gas image in the vehicle. Generally, the latent image may be developed by softening the vehicle by heating to enable the gas in the light-struck areas to expand into bubbles or vesicles which have a light-scattering or reflecting activity. A typical assembly is described in GB patent specification No. 861,250.

Vesicular images recorded in some vesicular recording materials have poor image quality such as low maximum projection density ($D_{max}$) and image colouration instead of a pure black image which is often preferred. These defects are attributed to the unacceptably small imaging bubbles or vesicles formed in such materials. Thus, bubbles or vesicles having a size (in their greatest dimension) less than 0.5 μm tend to selectively scatter or reflect light in the wavelength range 400 to 500 nm with the result that the image has a brownish appearance upon projection.

Certain terms employed throughout this specification have the following meaning:

"Maximum projection density" ($D_{max}$) relates to the densest image which can be produced in a processed material, the values quoted hereinafter being measured by a Macbeth densitometer TD 528 at an aperture of f4.5 using a Wratten 106 filter.

"Density ratio of 106:94" is a measure of the blackness of the image and is the ratio of the maximum projection density ($D_{max}$) determined as above with a Wratten 106 filter and the density determined in the same manner but using a Wratten 94 filter. The ratio of the densities gives a measure of the "blackness" of the image because of the relative spectral absorptions of the two filters. A vesicular image with a higher ratio will appear "blacker" when viewed by transmitted light than a vesicular image with a lower ratio. Image blackness is superior at ratios exceeding about 0.80.

"Tonal range" relates to the relative ability of the material to reproduce accurately the varying tones in an object, the values quoted hereinafter being assessed as the number of visible image steps upon the material after exposure through a Kodak No. 2 step tablet and development. The first step of the tablet is transparent and each subsequent step increasingly opaque. The ability of the material to reproduce images of the successive steps is a measure of its tonal range.

"Gamma" represents the rate of change of image density with respect to changes in the logarithm (base 10) of the exposure and is derived from the characteristic curve, i.e. the curve of projection density/$\log_{10}$ exposure, of the material, as the slope of the straight-line portion of the curve, the projection density being determined for each step on the recording material after exposure through a Kodak No. 2 step tablet and development assessed using a Macbeth densitometer TD 528 at an aperture of f4.5 using a Wratten 106 filter. The plotted exposure value relates to the UV diffuse densities of the Kodak No. 2 step tablet. For low gamma a small change in exposure produces a small change in density whilst for high gamma the same small change in exposure produces a larger change in density.

"Nitrogen permeability constant" refers to the volume of nitrogen in $cm^3$ which diffuses in one second through one cm of a sample of the polymeric vehicle, one $cm^2$ in area, and under a pressure gradient of one cm of mercury at a constant temperature of 25° C.

"$D_{min}$" relates to the lowest density which can be obtained in a processed material, the values quoted hereinafter being measured by a Macbeth densitometer TD 528 at an aperture of f4.5 using a Wratten 106 filter.

"Comparative speed rating" defines the comparative speeds of recording materials at defined projection densities and is derived from the characteristic curve (projection density/$\log_{10}$ exposure derived in the determination of "gamma"). The speed rating at ($1.8+D_{min}$) is determined from this curve as the $\log_{10}$ exposure value corresponding to a projection density of 1.80 plus the minimum projection density ($D_{min}$). The comparative speed rating of various recording materials at ($1.8+D_{min}$) is derived by taking the lowest speed rating as corresponding to a value of 100% and expressing the speed ratings of the other recording materials as percentages of that value.

According to the present invention a recording material suitable for vesicular imaging comprises a plastics vehicle comprising a thermoplastics component and dispersed uniformly therein a sensitising agent which releases a vesicle-forming gas upon exposure to light, said thermoplastics component being softenable upon heating to permit the gas released by the sensitising agent in the light-struck areas to form light-scattering or reflecting vesicles therein, said thermoplastics vehicle also containing at least one sulphone or sulphonamide wherein the sulphone has the general formula:

$$R^1—SO_2—R^2$$

in which $R^1$ and $R^2$ are selected from aromatic radicals and the sulphonamide has the general formula:

$$R^3—SO_2—NR^4R^5$$

in which $R^3$ is a hydrocarbon radical and $R^4$ and $R^5$ are each either hydrogen atoms or hydrocarbon radicals, the amount of sulphone or sulphonamide being in the range 1 to 100% by weight based upon the weight of the thermoplastics component of the vehicle.

According to another aspect of the invention, a process for the production of a recording material suitable for vesicular imaging comprises producing a plastics vehicle comprising a thermoplastics component having dispersed uniformly therein a sensitising agent which releases a vesicle-forming gas upon exposure to light, said thermoplastics component being softenable upon heating to permit the gas released by the sensitising agent in the light-struck areas to form light-scattering or reflecting vesicles therein, said plastics vehicle also containing at least one sulphone or sulphonamide wherein the sulphone has the general formula:

$$R^1—SO_2—R^2$$

in which $R^1$ and $R^2$ are selected from aromatic radicals and the sulphonamide has the general formula:

$R^3—SO_2—NR^4R^5$ in which $R^3$ is a hydrocarbon radical and $R^4$ and $R^5$ are each either hydrogen atoms or hydrocarbon radicals, the amount of sulphone or sulphonamide being in the range 1 to 100% by weight based upon the weight of the thermoplastics component of the vehicle.

The invention also relates to a process for forming an image in a vesicular imaging material, wherein the vesicular imaging material comprises a plastics vehicle applied to a carrier sheet or film, said plastics vehicle comprising a thermoplastics component and dispersed uniformly therein a sensitising agent which is nonreactive with said thermoplastics component and releases a vesicle-forming gas by decomposition upon exposure to light, said thermoplastics component being softenable upon heating to permit the gas released by the sensitising agent in the light-struck areas to form light-scattering or reflecting vesicles therein, said plastics vehicle also containing at least one sulphone or sulphonamide wherein the sulphone has the general formula:

$R^1—SO_2—R^2$ in which $R^1$ and $R^2$ are selected from aromatic radicals and the sulphonamide has the general formula:

$R^3—SO_2—NR^4R^5$ in which $R^3$ is a hydrogen radical and $R^4$ and $R^5$ are each either hydrogen atoms or hydrocarbon radicals, the sulphone or sulphonamide being present in an amount in the range 1 to 100% by weight based upon the weight of the thermoplastics component, said image being formed in the plastics vehicle by exposing the vesicular imaging material to a light image thereby causing the sensitising agent to release gas in the light-struck areas and heating the vesicular imaging material to soften the thermoplastics component whereby a recorded image is formed therein by the expansion into imaging vesicles of gas released by the sensitising agent, said sulphone or sulphonamide being present in the plastics vehicle in an effective amount whereby the recorded image has a density ratio of 106:94 exceeding 0.80.

The presence of the sulphone and/or sulphonamide additive in an amount in the range 1 to 100% by weight results in imaging vesicles generally larger in size than those obtainable heretofore and a corresponding improvement in maximum projection density ($D_{max}$) together with a substantially uniform scattering of visible light wavelengths and hence acceptable image blackness. Lower amounts of the sulphone and/or sulphonamide additive result in a smaller increase in the vesicle size, amounts less than 1% by weight being insufficient to produce an acceptable increase in size and a correspondingly insufficient modification to image properties. Amounts of sulphone and/or sulphonamide not exceeding 50% by weight are particularly preferred according to the invention. It will be appreciated that the optimum effective amount of the sulphone and/or sulphonamide depends upon the nature of the thermoplastics component included in the plastics vehicle, as illustrated hereinafter for the preferred thermoplastics components. The invention relates to those amounts of the sulphone and/or sulphonamide additive in the range 1 to 100% by weight which are effective in improving the maximum projection density and blackness of the image.

Generally, for a particular amount of sulphone and/or sulphonamide additive, the size of the imaging vesicles increases with increased imaging temperature. Consequently, the imaging properties associated with a particular vesicle size may be achieved with smaller amounts of sulphone and/or sulphonamide additive when higher development temperatures are used. It is also possible to modify the vesicular development temperature of the recording material by varying the amount of the sulphone and/or sulphonamide additive. Hence, for example, the development temperature of the thermoplastic components may be depressed by the addition of the sulphone and/or sulphonamide additive whilst providing images having acceptable quality, and in particular satisfactory maximum projection density ($D_{max}$) and image blackness. For example, some thermoplastics components have inherent development temperatures exceeding the maximum development temperature of commercial developing machines and the presence of a sulphone and/or sulphonamide is effective in depressing the development temperature to a value within the operative temperature range of such machines.

The plastics vehicle may optionally include any of the known additives such as surfactants and stabilising acids.

The recording material preferably comprises a layer of the plastics vehicle applied as a recording layer to a carrier sheet or film. Opaque carriers may be used in recording materials when the image is to be viewed by reflection. In such an assembly, the image vesicles appear white by reflection of incident light, the whiteness being enhanced by the presence of the sulphone and/or sulphonamide. The opaque carrier is preferably dark in colour to contrast with the image and may comprise a pigmented or coloured plastics film or sheet or paper or card. When the image is to be viewed by light-scattering the carrier is preferably a transparent plastics sheet or film which may consist of any suitable plastics material such as cellulose esters, e.g. cellulose acetate, polystyrene, polyamides, polymers and copolymers of vinyl chloride, polycarbonate, polymers and copolymers of olefines, e.g. polypropylene, polysulphones and linear polyesters which may be obtained by condensing one or more dicarboxylic acids or their lower alkyl diesters, e.g. terephthalic acid, isophthalic, phthalic, 2,5-, 2,6- and 2,7-naphthalene dicarboxylic acid, succinic acid, sebacic acid, adipic acid, azelaic acid, diphenyl dicarboxylic acid and hexahydroterephthalic acid or bis-p-carboxyl phenoxy ethane, optionally with a monocarboxylic acid, such as pivalic acid, with one or more glycols, e.g. ethylene glycol, 1,3-propanediol, 1,4-butanediol, neopentyl glycol and 1,4-cyclohexanedimethanol. Biaxially oriented and heat-set films of polyethylene terephthalate are particularly useful as carriers according to this invention.

The sulphone and sulphonamide additives are preferably selected from those materials which are soluble in common organic solvents suitable for coating the recording layer, as described below.

The plastics vehicle may contain any sulphone or sulphonamide of the general formulae described hereinbefore or a mixture of two or more of such sulphones and sulphonamides. Suitable sulphones include diphenyl sulphone, bis-(4-hydroxyphenyl) sulphone, bis-(4-chlorophenyl) sulphone, and 4,4'-bis(4-methylphenoxy) diphenylsulphone

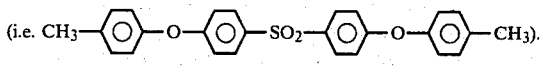

Suitable sulphonamides include N-ethyl p-toluene-sulphonamide ($C_9H_{13}SO_2N$; MW=199) and N-cyclohexyl p-toluene-sulphonamide ($C_{13}H_{19}SO_2N$; MW=253), o-toluene sulphonamide ($C_7H_9SO_2N$; MW=171) and p-toluene sulphonamide ($C_7H_9SO_2N$; MW=171).

The thermoplastics component of the plastics vehicle may comprise any of the thermoplastic polymers known in the art for use in vesicular imaging layers and having properties such that light-scattering or reflecting vesicles can be formed therein. Suitable thermoplastics include polymers of vinylidene chloride as described in British patent specification 861 250, the polymers described in British patent specification Nos. 1,272,894, 1,276,608, 1,278,004, 1,312,573, 1,330,344, 1,352,559, 1,352,560 and 1,400,245, copolymers derived from comonomers comprising acrylonitrile and a substituted or unsubstituted styrene, and terpolymers of vinylidene chloride, acrylonitrile and methyl methacrylate.

One preferred thermoplastics component suitable for inclusion in the plastics vehicle according to the invention comprises terpolymers of vinylidene chloride/acrylonitrile or derivative thereof/methyl methacrylate, especially terpolymers comprising the respective amounts of 30 to 45/40 to 60/5 to 20 mole %. These terpolymers provide excellent image thermal stability and the recording materials comprising them are resistant to fogging when subjected to relatively high temperatures, e.g. by the lamp employed for exposing the material during the imaging operation, such temperatures being lower than the temperatures normally employed for softening the vehicle to permit the latent gas image to expand into image recording vesicles. Increasing amounts of acrylonitrile or derivative thereof within the range 40 to 60 mole % result in higher glass-transition temperatures and hence provide thermal stability at correspondingly higher temperatures. Likewise, increasing amounts of methyl methacrylate in the range 5 to 20 mole % result in thermal stability at higher temperatures. A useful combination of imaging properties and thermal stability is provided by terpolymers of 40 to 45 mole % vinylidene chloride, 40 to 50 mole % acrylonitrile or derivative thereof and 8 to 17 mole % methyl methacrylate. Especially preferred terpolymers comprise a terpolymer of 42.5 mole % vinylidene chloride, 42.5 mole % acrylonitrile and 15 mole % methyl methacrylate and a terpolymer of 42.5 mole % vinylidene chloride, 47.5 mole % acrylonitrile and 10 mole % methyl methacrylate.

Amounts of the sulphone and/or sulphonamide in the range 1 to 20% by weight based upon the weight of the thermoplastics component have been found to be especially effective in providing a useful combination of vesiculation properties, including maximum projection density ($D_{max}$) and image blackness when included in vehicles comprising such vinylidene chloride/acrylonitrile or derivative thereof/methyl methacrylate terpolymers. Amounts of at least 5% by weight and preferably at least 10% by weight have been found to be particularly effective with such terpolymer vehicles.

Another preferred group of thermoplastics materials suitable for use as the thermoplastics component comprises copolymers consisting of vinylidene chloride/acrylonitrile, especially copolymers consisting of the 45 to 85 mole % vinylidene chloride.

Amounts of the sulphone and/or sulphonamide in the range 1 to 10% by weight based upon the weight of the thermoplastics component have been found to be especially effective in providing a useful combination of vesiculation properties including maximum projection density ($D_{max}$) and image blackness when included in vehicles comprising such vinylidene chloride/acrylonitrile copolymers. Amounts of the sulphone and/or sulphonamide additive exceeding 10% by weight provide similar properties but without any substantial improvement in the properties.

Sulphone and/or sulphonamide additives are particularly effective in depressing the vesicular development temperature of a further preferred group of thermoplastics components according to the invention which comprises a copolymer comprising acrylonitrile in a molar proportion of at least 55 mole % and a substituted or unsubstituted styrene, e.g. alpha methyl styrene, and which is preferably employed in the presence of a surfactant in an amount of at least 1% by weight based on the weight of the copolymer. Such a copolymer may be derived from one or more additional comonomers provided the resulting copolymer is softenable upon heating to facilitate the formation of light-scattering vesicles. However, the copolymer is preferably derived from acrylonitrile and a substituted or unsubstituted styrene alone. Proportions of acrylonitrile less than 55 mole % exhibit no or very poor vesicular activity and are not therefore suitable for the production of recording materials. For example, a recording layer comprising a copolymer of equimolar proportions of acrylonitrile and styrene, a sensitising agent and a surfactant exhibited negligible vesiculation upon exposure to light and even when subjected to a water treatment for 10 seconds as taught in U.S. patent specification 3,149,971.

Amounts of the sulphone and/or sulphonamide additive less than 1% by weight based upon the weight of the acrylonitrile/styrene copolymer result in an inadequate modification of the vesicle size and imaging properties. It is preferred that the amount of the sulphone and/or sulphonamide additive added to the acrylonitrile/styrene copolymers should be at least 5% by weight and most preferably at least 20% by weight based upon the weight of the copolymer. The lower preferred amounts, i.e. down to 5% by weight, of the sulphone and/or sulphonamide additive provide a particularly beneficial increase in vesicle size and hence maximum projection density and acceptable image blackness at higher vesicular development temperatures, e.g. temperatures of at least 130° C., whilst the higher preferred amounts, i.e. at least 20% by weight, of the sulphone and/or sulphonamide additive provide similar improvements over a wider range of vesicular development temperatures, e.g. down to about 100° C. Amounts of the sulphone and/or sulphonamide used with such acrylonitrile/styrene copolymers may be as high as 100% by weight based upon the weight of the copolymer. However, it is generally preferred to employ amounts of the additive not exceeding 50% by weight based upon the weight of the copolymer since greater amounts do not result in any significant improvement in imaging properties under normal conditions of development, e.g. vesicular development temperatures of about 100° C. Amounts not exceeding 20% generally provide adequate image properties at higher vesicular development temperatures, e.g at least 130°

C.; greater amounts providing no significant improvement in properties.

It has been observed that some plastics vehicles only produce satisfactory image properties, such as an acceptable maximum projection density ($D_{max}$) and adequate image blackness, when developed at relatively high temperatures. Such development temperatures may in fact exceed the maximum operating temperature of some commercially available developing machines. Vehicles comprising acrylonitrile/styrene copolymers generally require heating at relatively high vesicular development temperatures (in the absence of a sulphone and/or sulphonamide additive), e.g. exceeding 130° C., to produce significant vesiculation properties. It has now been discovered that amounts of the sulphone and/or sulphonamide additive broadly in the range specified above and preferably in the range 20% to 50% by weight based upon the weight of the copolymer depress the effective vesicular development temperature of the recording material, e.g. to about 100° C., at which acceptable vesiculation properties, including maximum projection density ($D_{max}$) and image blackness, are obtained with vehicles comprising such acrylonitrile/styrene copolymers.

Copolymers of acrylonitrile and styrene as specified above and comprising molar proportions of acrylonitrile exceeding about 85 mole % are insoluble in organic solvents such as acetone which may be used for the application of the recording layer to a carrier sheet or film. Accordingly, when a recording layer is applied to a carrier sheet or film from such a solvent, the copolymer preferably comprises no more than about 85 mole % of acrylonitrile. Recording layers comprising copolymers in which the molar proportion of acrylonitrile exceeds about 85 mole % may be applied to carrier sheets or films by alternative coating operations, e.g. by melt extrusion. Generally, however, it is preferred to apply the recording layer from a solution and the preferred copolymer therefore comprises up to about 85 mole % of acrylonitrile. Most preferably, the copolymer comprises from 65 to 82 mole % of acrylonitrile.

Terpolymers of acrylonitrile and styrene suitable for use in the plastics vehicle may comprise from 70 to 75 mole % of acrylonitrile, 15 to 25 mole % of a substituted or unsubstituted styrene and up to 10 mole % of a third comonomer such as acrylic acid or a vinyl chloroacetate.

The presence of a surfactant has been discovered to be essential to the vesiculation of plastics vehicles comprising a copolymer of acrylonitrile and a substituted or unsubstituted styrene and amounts of at least 1% by weight are essential to the provision of satisfactory vesiculating properties. Below 1% by weight of the surfactant, whilst providing vesiculation, is undesirable since poor tonal range and relatively low speed ratings result. The amount of surfactant required to achieve satisfactory vesiculation may be up to 20% by weight based upon the weight of the acrylonitrile/substituted or unsubstituted styrene copolymer. Generally, no more than 10% by weight and preferably no more than 5% by weight of the surfactant is required to provide acceptable vesiculation. Amounts of at least 2% by weight are particularly effective whilst amounts of at least 3% by weight may be used if desired.

The copolymer of acrylonitrile and substituted or unsubstituted styrene is preferably homogeneous by which is meant that all the copolymer molecules contain substantially the same proportions of the comonomeric constituents. Such homogeneous copolymers may be produced by metering the comonomeric ingredients to the polymerisation medium so as to maintain compositional homogeneity and to achieve the desired copolymer formulation, e.g. as described in United States patent specification 2,559,155 or British patent specification No. 1,197,721.

Surfactants may be employed during the preparation of the acrylonitrile/substituted or unsubstituted styrene copolymer and residual amounts of surfactant may remain in the resulting copolymer according to the method of isolation and washing of the copolymer. Conventional processes for the emulsion polymerisation of such copolymers in the presence of surfactants typically result in copolymers containing residual amounts of surfactant, depending upon the nature of the isolation and washing operations, not exceeding 0.5% by weight based on the weight of the copolymer and commonly in the region of 0.1% by weight or less. Such amounts of residual surfactant are insufficient to provide the vesiculating properties achieved according to the present invention. When residual surfactant is present in the copolymer, additional surfactant should be added such that the total amount of surfactant is at least 1% by weight based on the weight of the copolymer and preferably accords with those amounts described above for providing vesiculation.

Whilst any form of surfactant, i.e. anionic, cationic and nonionic, is effective in providing vesiculation properties, it has been found that anionic surfactants have additional activity by extending the tonal range and reducing the gamma of the vesicular recording material. For example, whilst cationic and nonionic surfactants rendered up to seven visible steps when tested on a step tablet by the procedure specified above and a gamma down to about 4.5, anionic surfactants gave up to eleven visible steps and a gamma down to about 2.5. Accordingly, for applications in which a low gamma is required, anionic surfactants are preferred. Mixtures of surfactants may be employed if desired.

The following surfactants are especially effective according to the invention:

Anionic Surfactants

Fatty alcohol sulphates, e.g. sodium lauryl sulphate; fatty alcohol ether sulphates, e.g. sodium lauryl ether sulphate; alkyl aryl sulphonates, e.g. sodium alkyl benzene sulphonate; alkyl sulphosuccinates, e.g. sodium dioctyl sulphosuccinate; and phosphate esters, e.g. neutralised phosphate esters; and salts of fatty acids, e.g. sodium laurate and ammonium laurate.

Nonionic Surfactants

Polyoxy-2-hydroxy-propylene alkyl phenols, e.g. polyoxy-2-hydroxy propylene (10) alkyl phenol; polyoxyethylene alcohols, e.g. lauryl alcohol ethoxylate; polyoxyethylene esters of fatty acids, e.g. mono-oleate ester of polyethylene glycol; polyoxyethylene alkyl amines, e.g. bis(2-hydroxyethyl) lauryl amine; polyoxyethylene alkyl amides, e.g. oleyl dialkanol (5) amide; polyol surfactants, e.g. sorbitan monolaurate, sorbitan monopalmitate, sorbitan mono-oleate, and polyoxyethylene sorbitan monolaurates; polyalkylene oxide block copolymers, e.g. polyoxyethylene polyoxypropylene glycol; and polyoxyethylene alkyl phenols, e.g. polyoxyethylene nonyl phenol derived from 4 moles of ethylene oxide per mole of nonyl phenol.

Cationic Surfactants

Quaternary ammonium compounds.

Plasticisers and additives which reduce the nitrogen permeability of the vehicle may be added to the vehicle if desired.

The sensitising agent incorporated into the vehicle may comprise any of the sensitising agents known in the vesicular art and should be non-reactive with the thermoplastics component. Likewise all of the decomposition products of the sensitising agent produced as a result of exposure to light, such as the vesicle-forming gas, should be non-reactive with the thermoplastics component. The preferred sensitising agents are those which liberate nitrogen on exposure to actinic light, especially ultra-violet light which is widely used in vesicular processing equipment, suitable agents including nitrogen-liberating diazonium salts, such as those which may be derived from the following amines:

N,N-dimethyl-p-phenylenediamine
N,N-diethyl-p-phenylenediamine
N,N-dipropyl-p-phenylenediamine
N-ethyl-N-$\beta$-hydroxyethyl-p-phenylenediamine
N,N-dibenzyl-3-ethoxy-4p-phenylenediamine
4-N-morpholino-aniline
2,5-diethoxy-4-N-morpholino-aniline
2,5-dimethoxy-4-N-morpholino-aniline
2,5-di-(n-butoxy)-4-N-morpholino-aniline
4-N-pyrrolidino-aniline
3-methyl-4-N-pyrrolidino-aniline
3-methoxy-4-N-pyrrolidino-aniline
2-ethoxy-4-N,N-diethylamino-aniline
2,5-diethoxy-4-benzoylamino-aniline
2,5-diethoxy-4-thio-(4'-tolyl)-aniline Other suitable sensitising agents include quinonediazides and especially that having the structure:

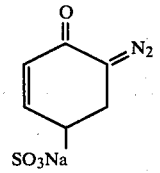

and azide compounds derived from the structure:

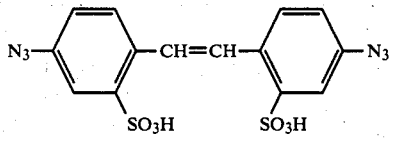

Alternatively, carbazido compounds (carboxylic acid azides) containing a hydroxyl or amino group in the position ortho to the carbazido group may be used.

Optimum image formation and vesiculation is obtained in plastics vehicles which include nitrogen-liberating sensitising agents when the thermoplastics component has a nitrogen permeability constant in the range $1\times10^{-15}$ to $1\times10^{-10}$.

Alternatively, other known sensitising agents which liberate gases other than nitrogen may be employed, e.g. those agents described in British patent specification No. 1,359,086 and U.S. Pat. No. 3,549,376.

The sensitising agent is suitably included in the plastics vehicle in an amount in the range 5 to 16% by weight based upon the weight of the thermoplastics component. Amounts of sensitising agent less than 5% by weight produce images of such low density that the image contrast is inadequate for satisfactory viewing. Higher amounts of sensitising agent release greater quantities of vesicle-forming gas and result in acceptable imaging when the amount is in the range 5 to 16% by weight. Above 16% by weight the liberation of gas becomes excessive and has a tendency to produce a high over pressure of gas in the plastics vehicle with the consequence that the gas may rupture the surface of the vehicle when it is heated to initiate vesicle formation.

If desired, a small quantity of a dyestuff and a stabilising acid may be included in the plastics vehicle.

When the recording layer is applied to a carrier as a solution any suitable common organic solvent may be employed, such as acetone or a mixture of acetone with butan-2-one, toluene and/or methanol.

If desired, the surface of the carrier may be pretreated and/or coated with an adhesion-promoting layer prior to the application of the recording layer. The adhesion of the recording layer to a plastics sheet or film carrier may in particular be improved by such a treatment. Polyethylene terephthalate film carriers may be pretreated by coating with solutions of materials having a solvent or swelling action on the film such as halogenated phenols in common organic solvents, e.g. solutions of p-chloro-m-cresol, 2,4-dichlorophenol, 2,4,6- or 2,4,5-trichlorophenol or 4-chlororesorcinol or a mixture of such materials in acetone or methanol. After application of such a solution the film surface can be dried and heated at an elevated temperature for a few minutes, e.g. 2 minutes at 60° C. to 100° C. If desired, the pretreating solution may also contain an adhesion-promoting polymer such as a partially hydrolysed copolymer of vinyl chloride and vinyl acetate.

As an alternative to, or in addition to, such a pretreatment, a material having a swelling or solvent action upon the film may be incorporated into the coating composition from which the recording layer is applied.

The recording layer may, if desired, be treated with an aqueous solution or steam or water vapour prior to imagewise exposure in accordance with established practice in the art, e.g. as described in U.S. Pat. No. 3,149,971. Such treatments are conventionally employed to extend the tonal range and to increase the sensitometric speed of the recording material.

The recording materials according to this invention may be exposed to a light image in a conventional manner to produce a latent image in the recording layer. The image may be developed in a conventional manner by heating immediately after light exposure to permit the gas vesicles to form in the light-struck areas. Fixing may then be accomplished by a further overall light exposure and permitting the gas evolved by the decomposition of the sensitising agent to diffuse out of the recording layer. Alternatively, the latent image may be reversal processed by permitting the gas evolved in the imagewise light-struck areas to diffuse out of the recording layer and then subjecting the material to an overall light exposure followed by immediate heating to form gas vesicles in the areas subjected to the overall exposure.

The invention is further illustrated by the following examples and comparative examples.

EXAMPLES 1 TO 6 AND COMPARATIVE EXAMPLES A TO C

A homogeneous acrylonitrile/styrene copolymer of respective molar proportions 75/25 was prepared by emulsion polymerisation at a reaction temperature of about 80° C. in the presence of a surfactant which is commercially available as 'Nansa' 1106 (an anionic sodium salt of alkyl benzene sulphonate). The copolymer was isolated by coagulation in methanol and washed with water then methanol and vacuum dried.

Traces of surfactant were associated with the copolymer after isolation in amounts of about 0.1% by weight based on the weight of copolymer.

Coating solutions comprising the resulting copolymer were made up to the following general sensitising composition:

| | |
|---|---|
| 75/25 mole % copolymer acrylonitrile/styrene | 10 g |
| 2,5-diethoxy-4-N—morpholino-benzene diazonium fluoroborate | 1.5 g |
| Maleic acid | 0.2 g |
| Sodium dioctyl sulphosuccinate (commercially available as 'Alcopol' O) | 0.2 g |
| Acetone | 58 g |

In Examples 1 to 6 and Comparative Examples B and C bis-(4-hydroxyphenyl) sulphone was added in varying amounts based on the weight of the acrylonitrile/styrene copolymer as indicated in Table 1, whilst in Comparative Example A none was added.

The solutions were uniformly coated onto one side of 100 micron thick transparent biaxially oriented and heatset films of polyethylene terephthalate which had been pretreated with a solution of 2 g of p-chloro-m-cresol in 100 ml of methanol and dried at 120° C. for 150 seconds.

The coated solutions were dried at 120° C. for 5 minutes and the dried films were then immersed in distilled water at 80° C. for 10 seconds and wiped dry.

The films were exposed through a Kodak No. 2 step tablet for 15 seconds to three parallel UV fluorescent lamps in a commercially available vesicular film printer (Canon Kal Printer 480 VC). Samples of the exposed films were developed immediately by passing through a commercially available developing machine (Canon Kal Developer 360 VS) set at a vesicular development temperature of 130° C.

The projection densities of the developed films were measured using a Macbeth Densitometer TD-528 at f4.5 aperture and either a Wratten 106 or a Wratten 94 filter.

The effect of the various amounts of the sulphone additive on the vesiculation properties is shown in Table 1. The products of Comparative Examples A to C had inferior maximum projection densities ($D_{max}$) and brownish images in comparison with the more acceptable products of Examples 1 to 6.

Samples of the coated films which had been exposed to give maximum projection density ($D_{max}$) were then allowed to naturally age for 24 hours and then place in an oven at 65° C. for 3 hours. After this time the maximum projection density ($D_{max}$) of the samples were remeasured. This test gives a measure of the thermal stability of the processed film and thus a measure of the ability of the film to retain density, e.g. in the hot environment of a microfilm reader. In all cases, i.e. Comparative Examples A to C and Examples 1 to 6 there was no measurable loss in density indicating good image thermal stability and the addition of the sulphone additive in Examples 1 to 6 resulted in no deterioration in relation to Comparative Examples A to C.

TABLE 8

| Example | % by weight based on weight of copolymer of bis-(4-hydroxyphenyl) sulphone added | $D_{max}$ with Wratten 106 filter | Density ratio of 106:94 | Size range of 50% of largest vesicles |
|---|---|---|---|---|
| Comparative Example A | 0 | 1.60 | 0.72 | 1 μm |
| Comparative Example B | 1% | 1.93 | 0.77 | 1 μm |
| Comparative Example C | 5% | 1.85 | 0.79 | 1 μm |
| 1 | 10% | 2.15 | 0.93 | 1–2 μm |
| 2 | 20% | 2.22 | 0.94 | 1–2 μm |
| 3 | 30% | 2.23 | 0.95 | 1–2 μm |
| 4 | 50% | 2.25 | 0.95 | 1–4 μm |
| 5 | 70% | 2.27 | 0.94 | 1–4 μm |
| 6 | 100% | 2.29 | 0.93 | 1–4 μm |

EXAMPLES 7 TO 10 AND COMPARATIVE EXAMPLES D AND E

The procedure of the previous examples was repeated using the amounts of bis-(4-hydroxyphenyl) sulphone additive indicated in Table 2 and with a lower vesicular development temperature, namely 100° C. The image properties are shown in Table 2. There was no measurable loss in image density after natural ageing and heating at 65° C. for 3 hours.

The products of Examples 7 to 10 exhibited improvements in maximum projection density ($D_{max}$) and image blackness over those of Comparative Examples D and E.

TABLE 2

| Example | % by weight based on weight of copolymer of bis-(4-hydroxyphenyl) sulphone added | $D_{max}$ with Wratten 106 filter | Density ratio of 106:94 | Size range of 50% of largest vesicles |
|---|---|---|---|---|
| Comparative Example D | 0 | 0.24 | 0.47 | 1 μm |
| Comparative Example E | 20% | 1.74 | 0.78 | 1 μm |
| 7 | 30% | 2.10 | 0.86 | 1–2 μm |
| 8 | 50% | 2.29 | 0.94 | 1–2 μm |
| 9 | 70% | 2.22 | 0.94 | 1–2 μm |
| 10 | 100% | 2.26 | 0.94 | 1–4 μm |

EXAMPLES 11 TO 15 AND COMPARATIVE EXAMPLE F

A homogeneous vinylidene chloride/acrylonitrile/methyl methacrylate terpolymer of respective molar proportions 42.5/47.5/10 was prepared by emulsion polymerisation in the presence of a surfactant which is commercially available as 'Manoxol' OT (sodium dioctyl sulphosuccinate).

The terpolymer was isolated by coagulation in an aqueous magnesium sulphate solution, washed with water and vacuum dried.

Coating solutions comprising the resulting terpolymer were made up to the general composition:

Vinylidene chloride/acrylonitrile/

-continued

| | |
|---|---|
| methyl methacrylate terpolymer 42.5/47.5/10 mole % | 20 g |
| Maleic acid | 0.4 g |
| 'Manoxol' OT (a commercially available surfactant - sodium dioctyl sulphosuccinate) | 0.4 |
| 2,5-diethoxy-4-N—morpholino-2,5-diethoxy-4-N-morpholino-benzene diazonium fluoroborate | 1.6 g |
| Methyl ethyl ketone | 100 g |

In Examples 11 to 15 certain sulphone and sulphonamide compounds were added to the coating solutions in varying amounts based on the weight of the terpolymer and as indicated in Table 3 whilst in Comparative Example F none was added.

The procedures described in Examples 1 to 6 and Comparative Examples A to C were used to apply the coating solutions to pretreated films of polyethylene terephthalate and to test the resulting recording material. In these examples and comparative example, however, a vesicular development temperature of 100° C. was used.

The effect of the additives on the vesiculation properties is shown in Table 3.

The product of Comparative Example F had inferior maximum projection density ($D_{max}$) and a brown image in comparison with the more acceptable products of Examples 11 to 15.

TABLE 3

| Example | Additive | % by weight of additive based on weight of terpolymer | $D_{max}$ with Wratten 106 filter | Density ratio of 106:94 |
|---|---|---|---|---|
| Comparative Example F | None | — | 1.12 | 0.59 |
| 11 | Diphenyl sulphone | 10% | 2.42 | 0.87 |
| 12 | Diphenyl sulphone | 20% | 2.43 | 0.87 |
| 13 | bis-(4-hydroxyphenyl) sulphone | 20% | 2.20 | 0.91 |
| 14 | bis-(3,5-dichlorodiphenyl) sulphone | 20% | 2.17 | 0.89 |
| 15 | A mixture of ortho and para toluene sulphonamides commercially available as 'Santicizer' 9 | 20% | 2.05 | 0.87 |

EXAMPLES 16 TO 18 AND COMPARATIVE EXAMPLE G

A homogeneous vinylidene chloride/acrylonitrile copolymer commercially available as 'Saran' F310 (analysis 70/30 mole % vinylidene chloride/acrylonitrile copolymer) was used in the following general coating composition:

| | |
|---|---|
| 'Saran' F310 | 20 g |
| Maleic acid | 0.4 g |
| 'Manoxol' OT (a commercially available surfactant - sodium dioctyl sulphosuccinate) | 0.4 g |
| 2,5-diethoxy-4-N—morpholino-benzene diazonium fluoroborate | 1.6 g |
| Methyl ethyl ketone | 80 g |

The procedure described in Examples 11 to 15 and Comparative Example F was repeated to apply coating solutions including bis-(4-hydroxyphenyl)sulphone additive in the amounts shown in Table 4 to pretreated films of polyethylene terephthalate and to test the resulting recording material, the test results also being shown in Table 4.

The products in Comparative Example G had inferior sensitometric speed and browner images compared with the more acceptable products of Examples 16 to 18.

TABLE 4

| Example | % by weight based on weight of copolymer of bis-(4-hydroxyphenyl) sulphone | $D_{max}$ with Wratten 106 Filter | Density ratio of 106:94 | Comparative speed rating at $D_{min}$ + 1.8 |
|---|---|---|---|---|
| Comparative Example G | 0 | 2.15 | 0.84 | 100% |
| 16 | 10% | 2.22 | 0.91 | 196% |
| 17 | 20% | 2.16 | 0.91 | 188% |
| 18 | 30% | 2.20 | 0.91 | 185% |

EXAMPLES 19 TO 21 AND COMPARATIVE EXAMPLES H AND I

A homogeneous vinylidene chloride/acrylonitrile/methyl methacrylate terpolymer of respective molar proportions 42.5/42.5/15 was prepared by emulsion polymerisation and isolated by a similar method to that describes in Examples 11 to 15 and Comparative Example F.

Coating solutions comprising the resulting terpolymer were made up to the general composition:

| | |
|---|---|
| Vinylidene chloride/acrylonitrile/methyl methacrylate terpolymer 42.5/42.5/15 mole % | 20 g |
| Maleic acid | 0.4 g |
| 'Manoxol' OT (a commercially available surfactant - sodium dioctyl sulphosuccinate) | 0.4 g |
| 2,5-diethoxy-4-N—morpholino-benzene diazonium fluoroborate | 1.6 g |
| Methyl ethyl ketone | 120 g |

The procedure described in Examples 1 to 6 and Comparative Examples A to C was repeated to apply coating solutions including bis-(4-hydroxyphenyl)sulphone additive in the amounts shown in Table 5 to pretreated films of polyethylene terephthalate and to test the resulting recording material (the vesicular development temperature being 130° C.), the test results also being shown in Table 5.

The product in Comparative Examples H and I had inferior properties and browner images compared with the more acceptable products of Examples 19 to 21.

TABLE 5

| Example | % by weight based on weight of terpolymer of bis-(4-hydroxyphenyl) sulphone | $D_{max}$ with Wratten 106 Filter | Density ratio of 106:94 | Comparative speed rating at $D_{min}$ + 1.8 |
|---|---|---|---|---|
| Comparative Example H | 0 | 2.19 | 0.89 | 100% |
| Comparative Example I | 1% | 2.17 | 0.89 | 230% |
| 19 | 5% | 2.23 | 0.93 | 274% |

TABLE 5-continued

| Example | % by weight based on weight of terpolymer of bis-(4-hydroxyphenyl) sulphone | $D_{max}$ with Wratten 106 Filter | Density ratio of 106:94 | Comparative speed rating at $D_{min}$ + 1.8 |
|---|---|---|---|---|
| 20 | 10% | 2.24 | 0.93 | 300% |
| 21 | 20% | 2.29 | 0.92 | 322% |

EXAMPLES 22 TO 23 AND COMPARATIVE EXAMPLES J, K AND L

The procedure of Examples 19 to 21 and Comparative Examples H and I was repeated using the amounts of bis-(4-hydroxyphenyl)sulphone additive indicated in Table 6, with the exception that a vesicular development temperature of 100° C. was used. The image properties are shown in Table 6.

The products of Examples 22 and 23 exhibited improvements in maximum projection density ($D_{max}$), image blackness and comparative speed rating over those of Comparative Examples J, K and L.

TABLE 6

| Example | % by weight based on weight of terpolymer of bis-(4-hydroxyphenyl) sulphone | $D_{max}$ with Wratten 106 Filter | Density ratio of 106:94 | Comparative speed rating at $D_{min}$ + 1.8 |
|---|---|---|---|---|
| Comparative Example J | 0 | 0.67 | 0.52 | too low to measure |
| Comparative Example K | 1% | 1.39 | 0.60 | too low to measure |
| Comparative Example L | 5% | 1.47 | 0.65 | too low to measure |
| 22 | 10% | 2.12 | 0.88 | 100% |
| 23 | 20% | 2.26 | 0.922 | 204% |

EXAMPLES 24 AND 25 AND COMPARATIVE EXAMPLES M AND N

The procedure of Examples 19 to 21 and Comparative Examples H and I was repeated using the amounts of 4,4'-bis(4-methylphenoxy) diphenylsulphone additive indicated in Table 7, with the exception that a vesicular development temperature of 100° C. was used. The image properties are also shown in Table 7.

The products of Examples 24 and 25 exhibited improvements in maximum projection density ($D_{max}$), image blackness and comparative speed rating over those of Comparative Examples M and N.

TABLE 7

| Example | % by weight based on weight of terpolymer of sulphone additive | $D_{max}$ with Wratten 106 Filter | Density ratio of 106:94 | Comparative speed rating at $D_{min}$ + 1.8 |
|---|---|---|---|---|
| Comparative Example M | 0 | 1.50 | 0.70 | too low to measure |
| Comparative Example N | 5% | 1.51 | 0.69 | too low to measure |
| 24 | 10% | 2.22 | 0.92 | 100% |
| 25 | 20% | 2.30 | 0.91 | 115% |

We claim:

1. A process for forming an image in a vesicular imaging material, wherein the vesicular imaging material comprises a plastics vehicle applied to a carrier sheet or film, said plastics vehicle comprising a thermoplastics component and dispersed uniformly therein a sensitising agent which is non-reactive with said thermoplastics component and releases a vesicle-forming gas by decomposition upon exposure to light, said sensitising agent present in an amount of at least 5% by weight based upon the weight of said thermoplastics component, said thermoplastics component being softenable upon heating to permit the gas released by the sensitising agent in the light-struck areas to form light-scattering or reflecting vesicles therein, said plastics vehicle also containing at least one sulphone or sulphonamide the sulphonamide having a maximum molecular weight of 253 wherein the sulphone has the general formula $$R^1—SO_2—R^2$$

in which $R^1$ and $R^2$ are selected from aromatic radicals and the sulphonamide has the general formula:

$$R^3—SO_2—NR^4R^5$$

in which $R^3$ is a hydrocarbon radical and $R^4$ and $R^5$ are each either hydrogen atoms or hydrocarbon radicals, the sulphone or sulphonamide being present in an amount in the range of 1 to 100% by weight based upon the weight of the thermoplastics component, said image being formed in the plastics vehicle by exposing the vesicular imaging material to a light image thereby causing the sensitising agent to release gas in the light-struck areas and heating the vesicular imaging material to soften the thermoplastics component whereby a recorded image is formed therein by the expansion into imaging vesicles of gas released by the sensitising agent, said sulphone or sulphonamide being present in the plastics vehicle in an effective amount whereby the recorded image has a density ratio of 106:94 exceeding 0.80.

2. A process according to claim 1, in which the vesicular imaging material is heated immediately after exposure to the light image to form imaging vesicles in the light-struck areas.

3. A process according to claim 1, in which the gas released by the sensitising agent as a result of exposure to the light image is permitted to diffuse out of the plastics vehicle, the vesicular imaging material is subjected to another light exposure and is then heated to soften the thermoplastics component thereby forming a reversal recorded image in the form of gas expanded into vesicles.

4. A process according to claim 1, in which the sulphone comprises diphenyl sulphone, bis-(4-hydroxyphenyl)sulphone, bis-(4-chlorophenyl)sulphone or 4,4'-bis(4-methylphenoxy)diphenylsulphone and the sulphonamide comprises N-ethyl-p-toluene-sulphonamide, N-cyclohexyl-p-toluene-sulphonamide, o-toluene sulphonamide or p-toluene sulphonamide.

5. A process according to claim 1, in which the thermoplastics component comprises a copolymer comprising acrylonitrile in a molar proportion of at least 55 mole % and a substituted or unsubstituted styrene and the sulphone and/or sulphonamide additive is present in an amount in the range 20 to 50% by weight based upon the weight of the thermoplastics component.

6. A process according to claim 1, in which the thermoplastics component comprises a terpolymer of vinylidene chloride/acrylonitrile/methyl methacrylate and the sulphone and/or sulphonamide additive is present in an amount in the range 5 to 20% by weight based upon the weight of the thermoplastics component.

7. A process according to claim 1, in which the thermoplastics component comprises a terpolymer of 30 to 45 mole % vinylidene chloride/42 to 60 mole % acrylonitrile/5 to 20 mole % methyl methacrylate.

8. A process according to claim 1, in which the thermoplastics component comprises a copolymer consisting of vinylidene chloride/acrylonitrile consisting of 45 to 85 mole % vinylidene chloride and the sulphone and/or sulphonamide additive is present in an amount in the range 1 to 10% by weight based upon the weight of the thermoplastics component.

9. A process according to claim 1, in which a layer comprising said plastics vehicle is applied as a coating to a carrier sheet or film.

10. A process according to claim 1, in which the carrier film comprises a biaxially oriented and heat-set film of polyethylene terephthalate.

11. A process according to claim 1, in which the maximum amount of sensitising agent is 16% by weight based upon the weight of said thermoplastic component.

* * * * *